US012753568B2

(12) United States Patent
Owston

(10) Patent No.: US 12,753,568 B2
(45) Date of Patent: Oct. 6, 2026

(54) WORKING MACHINE

(71) Applicant: J.C. BAMFORD EXCAVATORS LIMITED, Uttoxeter (GB)

(72) Inventor: Edward Owston, Uttoxeter (GB)

(73) Assignee: J.C. Bamford Excavators Limited, Uttoxeter (GB)

( * ) Notice: Subject to any disclaimer, the term of this patent is extended or adjusted under 35 U.S.C. 154(b) by 226 days.

(21) Appl. No.: 18/324,974

(22) Filed: May 27, 2023

(65) Prior Publication Data

US 2024/0018741 A1 Jan. 18, 2024

(30) Foreign Application Priority Data

May 27, 2022 (GB) ..... 2207836

(51) Int. Cl.
*E02F 3/43* (2006.01)
*E02F 3/34* (2006.01)

(52) U.S. Cl.
CPC ..... *E02F 3/434* (2013.01); *E02F 3/3402* (2013.01); *E02F 3/3414* (2013.01)

(58) Field of Classification Search
CPC ..... E02F 3/434; E02F 3/3402; E02F 3/3414; E02F 3/431; E02F 9/2012; E02F 3/286; E02F 9/2203; E02F 9/265
USPC ..... 701/50
See application file for complete search history.

(56) References Cited

U.S. PATENT DOCUMENTS

| | | | | |
|---|---|---|---|---|
| 4,910,662 | A | 3/1990 | Heiser et al. | |
| 7,140,830 | B2 * | 11/2006 | Berger | E02F 9/24 414/699 |
| 2022/0154427 | A1 * | 5/2022 | Misaki | E02F 9/2267 |

FOREIGN PATENT DOCUMENTS

| | | | |
|---|---|---|---|
| EP | 1081292 | * | 8/2000 |
| EP | 1081292 | A1 | 3/2001 |
| EP | 3358087 | * | 1/2018 |
| EP | 3358087 | A1 | 8/2018 |
| EP | 3617130 | A1 | 3/2020 |
| JP | 4041861 | B2 | 2/2008 |
| WO | WO-2022/055856 | A1 | 3/2022 |

OTHER PUBLICATIONS

Search Report issued in. GB 2207836.4, dated Nov. 18, 2022.
Extended European Search Report isued in EP 23173626.5, dated Sep. 28, 2023.
Examination Report, European Application No. 23173626.5, Sep. 8, 2025.

* cited by examiner

*Primary Examiner* — Muhammad Shafi
(74) *Attorney, Agent, or Firm* — MARSHALL, GERSTEIN & BORUN LLP

(57) ABSTRACT

A working machine includes a body, a telescopic working arm extendable via a first actuator, and a bucket pivotally mounted to the working arm and pivotable via a second actuator. The working machine also includes a first controller to control the first actuator and a second controller to control the second actuator, in the first mode of operation. In the second mode of operation, the second controller simultaneously controls the first actuator and the second actuator, and upon activation of the second mode of operation and actuation of the first and second actuators, the leading edge of the bucket moves in a direction away from the body of the machine.

20 Claims, 5 Drawing Sheets

WORKING MACHINE

FIELD

The present teachings relate to a working machine.

BACKGROUND

Off-highway vehicles or working machines are for example those used in construction industries configured to transport loads over a surface (e.g. backhoe loaders, slew excavators, telescopic handlers, forklifts, skid-steer loaders etc.). These working machines typically have a body supported by a ground-engaging propulsion structure such as front and rear wheels, or a pair of endless tracks. To propel the working machine, a drive arrangement, including for example a transmission and a prime mover such as an internal combustion engine or electric motor, provides motive power to the ground-engaging propulsion structure. Working machines typically have a working arm pivotally mounted to the body of the machine, and a working implement, such as a bucket, attached to the end of the arm via a coupling device. Attachment of the working implement enables the working machine to perform a variety of tasks on a work site.

It is common for such working machines to pick up a load via the load interaction structure and discharge said load at height into a walled container, such as an open topped trailer or wagon. The movements of the working arm and the working implement are controlled by an operator via one or more controllers so as to discharge a load into said container. A problem with such a manual discharging operation is that the working arm and/or the working implement may inadvertently collide with the container during a discharge operation.

The present teachings seek to overcome, or at least mitigate the problems of the prior art.

SUMMARY

A first aspect provides a working machine comprising: a body; a working arm connected to the body and configured to be telescopically extendable by a first actuator between a retracted position and an extended position; a bucket defining a leading edge and mounted to a distal end of the working arm so as to be pivotable about an axis orthogonal to an elongate axis of the working arm by a second actuator; a control system configured to activate first and second modes of operation; a first controller configured to control the first actuator in the first mode of operation; and a second controller configured to control the second actuator in the first mode of operation, wherein the control system is configured such that, in the second mode of operation, the second controller simultaneously controls the first actuator to extend the working arm and the second actuator to pivot the bucket in a direction towards a discharge position, and wherein, upon activation of the second mode of operation and actuation of the first and second actuators, the leading edge of the bucket moves in a direction away from the body of the machine.

Providing first and second modes of operation enables the working arm to be extended/retracted and the bucket to be pivoted independently in the first mode of operation.

Advantageously, the configuration of the control system enables the bucket to moves in an arc-shaped over a lip of container to avoid a collision with the lip of the container.

In the second mode of operation, the leading edge may move at least in a forward direction relative to the body of working the machine.

The forward movement of the leading edge of the bucket may be movement along an axis parallel to a fore-aft direction of the working machine. The fore-aft direction may be defined as a direction substantially parallel to the general direction between front and rear ends of the body or between the front and rear wheels.

In the second mode of operation, the leading edge of the bucket may decrease in height, and wherein said decrease in height is restricted to a pre-determined distance.

Advantageously, the configuration of the control system to restrict lowering (i.e. a reduction in height along a substantially upright axis) of the bucket to be within a predetermined range in the second mode of operation helps to inhibit the bucket from inadvertently striking an object, such as a dump truck for example, when discharging a load from the bucket.

Upon activation of the simultaneous control of the first and second actuators, a lower extent of the bucket may define a first height and the first and second actuators may be configured to move a lower extent of the bucket above the first height thereby preventing descent of the lower extent below the first height.

This has been found to further helps to inhibit the bucket from inadvertently striking an object, such as a dump truck for example, when discharging a load from the bucket.

In the second mode of operation, the control system may be configured to actuate the second actuator in response to an input received from the second controller and to actuate the first actuator based on a predetermined ratio relative to the actuation of the second actuator.

Advantageously, such a configuration of the control system allows extension of the arm to be controlled based on one variable simplifying operation of the system. Moreover, such a configuration of the control system enables the first actuator to be controlled via open-loop control, simplifying implementation of the system.

The ratio may be based on an initial position of the bucket relative to the working arm and/or an initial position of the bucket relative to the body upon activation of the second mode of operation.

Advantageously, determining the ratio based on the initial position of the bucket enables the ratio to be chosen such that the bucket follows a desired path in the second mode of operation. For example, such that the bucket moves in an arc-shaped path that enables the bucket to avoid collision with a lip of a container when the bucket is discharging a load into said container.

The initial position of the bucket may be determined based on one or more of: an angle of the bucket relative to the working arm; an angle of the working arm relative to the body; an extension of the working arm; and an angle of the bucket relative to the body.

The ratio may be based on one or more of: a size of the bucket; a shape of the bucket; and/or a material intended to be carried by the bucket.

Advantageously, determining the ratio based on the size and/or shape of the bucket and/or a type of material with particular flowing properties enables the movement of the bucket in the second mode of operation to be customized depending on the application.

The working machine may comprise an operator input for selecting a size and/or shape of the bucket.

The first and second modes of operation may be selected via an input member, such as a button or switch.

Advantageously, the input member enables the operator to activate the second mode of operation only when needed, e.g. when discharging a load from the bucket into a container.

The input member may be located on the second controller.

The second mode of operation may be selected only whilst the input member is engaged.

Advantageously, such an arrangement provides a 'hold-to-run' feature, which enables an operator of the working machine to rapidly switch between the first and second modes of operation.

The second controller may be a joystick and the first controller may be a control member, such as button, switch, lever or wheel provided on the joystick.

In the second mode of operation, the control system may be configured to restrict a pivoting speed of the bucket.

Advantageously, such a configuration of the control system may help the control system to maintain control of the bucket of the position of the bucket.

The control system may be configured to restrict the pivoting speed of the bucket based on an initial position of the bucket upon activation of the second mode of operation.

Advantageously, restricting the pivoting speed of the bucket based on the initial position of the bucket may enable the bucket to be controlled such that the bucket follows a desired path in the second mode of operation. For example, such that the bucket moves in an arc-shaped path that enables the bucket to avoid collision with a lip of a container when the bucket is discharging a load into said container.

The initial position of the bucket may be determined based on one or more of: an angle of the bucket relative to the working arm; an angle of the working arm relative to the body; an extension of the working arm; and an angle of the bucket relative to the body.

The control system may be configured to restrict the pivoting speed of the bucket based on one or more of: a size of the bucket; a shape of the bucket; and/or a material intended to be carried by the bucket.

Advantageously, restricting the pivoting speed of the bucket based on the size and/or shape of the bucket and/or a type of material with particular flowing properties enables the movement of the bucket in the second mode of operation to be customized depending on the application.

The working machine may comprise an operator input for selecting a size and/or shape of the bucket.

In the second mode of operation, the control system may be prevented from actuating the first actuator until the bucket has reached a predetermined position relative to the working arm.

Advantageously, such a configuration of the control system may inhibit the control system from extending the working arm when not required, e.g. when not discharging a load from the bucket. For example, an operator of the working machine may wish to pivot the bucket towards the discharge position by a small amount to level off the load contained therein, and therefore extension of the working arm in this case is not required.

In the second mode of operation, the control system may be configured to activate the simultaneous control of the first and second actuators once the bucket has reached the predetermined position relative to the working arm.

The predetermined position of the bucket relative to the working arm may be based on a size and/or shape of the bucket; optionally, wherein the control system may receive an operator input corresponding to the size and/or shape of the bucket.

Advantageously, determining the predetermined position based on the size and/or shape of the bucket enables the predetermined position to be chosen such that the bucket follows a desired path in the second mode of operation.

The working arm may be inclinable relative to the body by a third actuator.

The second controller may be configured to control the third actuator in the first and second modes of operation.

In the second mode of operation, the control system may be configured to prevent actuation of the third actuator.

Advantageously, preventing actuation of the third actuator in the second mode of operation may help to ensure that the bucket follows a desired path, especially when extension of the working arm is controlled according to the predetermined ratio.

In the second mode of operation, the leading edge of the bucket may move along a substantially non-linear path, optionally wherein the leading of the paths may move along a curved or arc-shaped path.

In the second mode of operation, a center of rotation of the bucket may be moved.

In the second mode of operation, a center of rotation of the bucket may be moved along a substantially linear path.

BRIEF DESCRIPTION OF THE DRAWINGS

Embodiments will now be described with reference to the accompanying drawings, in which.

DETAILED DESCRIPTION OF EMBODIMENT(S)

Figure 1:
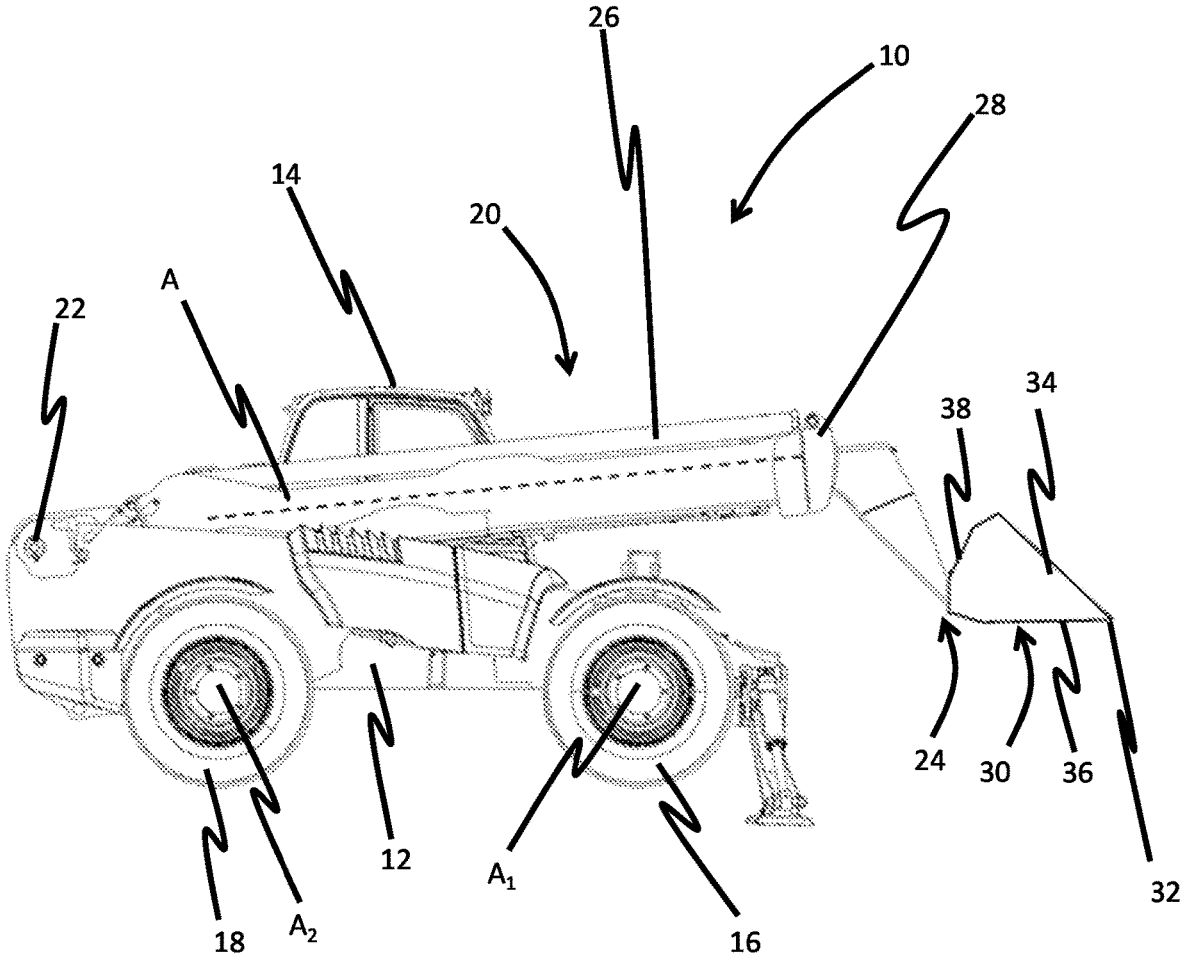
FIG. 1 is a side view of a working machine according to an embodiment of the present teachings.
Figure 2:
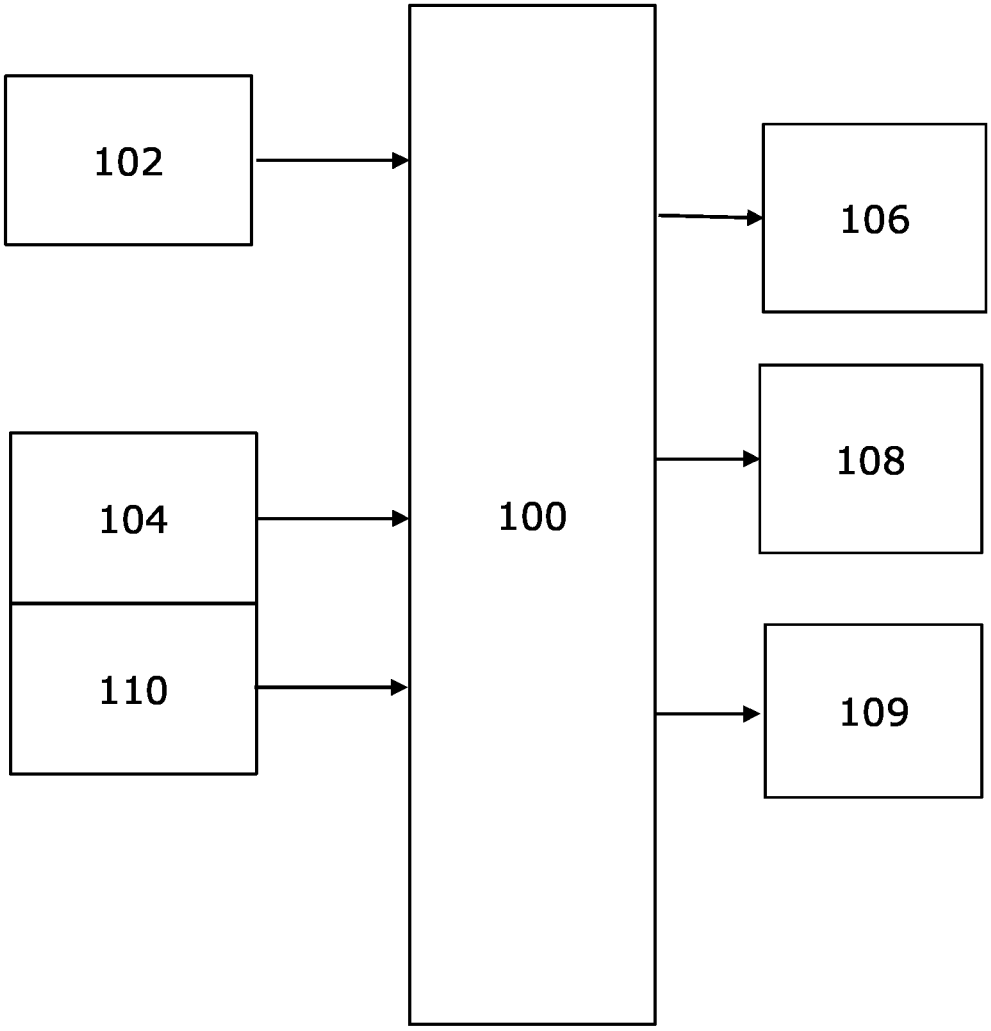
FIG. 2 is a block diagram of a control system of the working machine of FIG. 1.

Referring firstly to FIGS. 1 and 2, an embodiment of the teachings includes a working machine 10. The working machine may be a load handling machine. The working machine 10 includes a machine body 12. The machine body 12 may include, for example, an operator's cab 14 from which an operator can operate the machine 10. The operator cab 14 may be mounted on the body 12 so as to be offset from a center of the body. Although in alternative arrangements, the cab 14 may be substantially central.

The working machine 10 has a ground engaging propulsion arrangement. The ground engaging propulsion arrangement or structure supports the body 12. A working arm 20 is pivotally connected to the body 12 so as to be inclinable relative to the body 12. The working arm 20 is connected to the body 12 by a mount 22 proximate a first end, or proximal end, of the working arm 20.

In some arrangements, the body 12 may include an undercarriage or chassis including the ground engaging propulsion arrangement, and a superstructure including the cab and arm, and the superstructure may be rotatable (e.g. about a substantially vertical axis) relative to the undercarriage/chassis. Put another way, the superstructure may be rotatable relative to the ground engaging propulsion structure. It will be appreciated that the mount 22 may be provided on the undercarriage/chassis or the superstructure.

The ground engaging propulsion structure includes a first, or front, axle A1 and a second, or rear, axle A2, each axle being coupled to a pair of wheels 16, 18. In other embodiments, the ground engaging propulsion structure may include a pair of endless tracks. One or both of the axles A1, A2 may be coupled to a drive arrangement (not shown) configured to provide motive power to the ground engaging propulsion structure (i.e. the axles A1, A2). The drive arrangement causes movement of the working machine 10 over a ground surface.

The working arm 20 is a telescopic arm. The telescopic arm 20 includes a plurality of sections, which are configured to be telescopically extendable. The sections are extendable by a first actuator 106. The length of the telescopic arm 20 is adjustable between a retracted position and an extended position. In the illustrated embodiment, the working arm 20 includes a first section 26 connected to the body 12 (i.e. the mount 22) and a second section 28 which is telescopically fitted to the first section 26. In this embodiment, the second section 28 of the working arm 20 is telescopically moveable with respect to the first section 26 such that the working arm 20 can be extended and retracted along an elongate axis A of the arm 20. Movement of the second section 28 with respect to the first section 26 of the working arm 20 is achieved by use of the first actuator 106, for example a double acting hydraulic linear actuator, an electric linear actuator, a telescopic extension ram, multiple extension rams, and/or a chain and pulley system. In alternative embodiments (not shown), the working arm 20 may include more than two sections, for example three, four or more sections. Each arm section may be telescopically fitted to at least one other section, and an actuator may be provided therebetween. In such embodiments, the first actuator 106 may include all such actuators.

In this embodiment, the working machine 10 is a telescopic handler. In other embodiments the working machine 10 may be any working machine including a telescopic working arm 20, such as a rotating telescopic handler, an excavator, a skid-steer loader, or a telescopic wheel loader, for example. Such working machines may be denoted as off-highway vehicles or as non-road mobile machinery.

A working implement in the form of a bucket or shovel 30 is mounted to a distal end 24 of the working arm 20. The bucket 30 defines a leading edge 32. The leading edge 32 is the lower edge of the opening of the bucket 30. The bucket 30 includes two parallel spaced apart side walls 34 joined via a floor or lower wall 36 and a rear wall 38. The lower wall 36 defines the leading edge 32, which extends transversely between the side walls 34. The leading edge 32 may include a cutting or bladed edge. The bucket 30 is pivotable relative to the working arm 20. The bucket 30 is pivotable about an axis orthogonal to the elongate axis A of the working arm 20. The bucket 30 is pivoted by a second actuator 108. The second actuator 108 is coupled between the bucket 30 and the arm 20.

The working machine 10 includes a first controller 102 configured to control the first actuator 106 in a first mode of operation. Put another way, the first controller 102 controls extension and retraction of the working arm 20 in the first mode of operation. The working machine 10 includes a second controller 104 configured to control the second actuator 108 in the first mode of operation. Put another way, the second controller 104 controls pivoting of the bucket in the first mode of operation. The working machine 10 includes a control system 100 configured to activate (i.e. switch between) the first mode of operation and a second mode of operation of the working machine 10.

In the present arrangement, the second controller 104 is provided as a joystick and the first controller 102 is a control member, such as button or switch, provided on the joystick 104. The first controller 102 may be a roller button on the joystick 104. In alternative arrangements, it will be appreciated that the first and second controllers may be provided as separate joysticks, or any other suitable arrangement of controllers may be used.

The working arm 20 is inclinable or pivotable relative to the machine body 12. The working arm 20 is inclinable about a substantially transverse axis located at the mount 22. Rotational movement of the working arm 20 about said transverse axis with respect to the machine body 12 is achieved by use of a third actuator 109. The third actuator 109 is coupled between the arm 20 and the body 12.

In the present arrangement, the second controller 104 is configured to control the third actuator 109. The second controller 104 is configured to control the third actuator 109 in the first and second modes of operation. In one example, displacement of the second controller 104 along a first axis (e.g. X-axis) may control the first actuator 106 and displacement of the second controller 104 along a second axis (e.g. a Y-axis) may control the third actuator 109. In alternative arrangements, the working machine 10 may include a further, or third, controller configured to control the third actuator 109.

In the illustrated embodiment, the first controller 102 and the second controller 104 provide inputs to the control system 100. The control system 100 provides inputs to the first actuator 106, the second actuator 108 and the third actuator 109. The control system 100 may include a microcontroller and/or a microprocessor. For example, the control system 100 may include a plurality of interconnected microcontrollers and/or microprocessors. Alternatively, the control system 100 may include any suitable controller device.

The first and second modes of operation are selected via an input member 110, such as a button or a switch. In the illustrated embodiment, the input member 110 is located on the second controller 104. In alternative embodiments (not shown), the input member 110 may be located on the first controller 102 or in any suitable location, for example, in the operator cabin 14.

In the first mode of operation, pivoting of the bucket and extension/retraction of the arm 20 are controlled separately. The control system 100 is configured such that, in the second mode of operation, the second controller 104 simultaneously controls the first actuator 106, to extend the working arm 20, and the second actuator 108 to pivot the bucket 30 in a direction towards a discharge position. Put another way, in the second mode of operation, the control system 100 is configured to extend the working arm 20, and to pivot the bucket 30 in a direction towards a discharge position. In exemplary embodiments, once the second mode of operation has been activated, the control system 100 is configured to prevent actuation of the third actuator 109. Put another way, the control system 100 is configured to prevent pivoting of the working arm 26 when in the second mode of operation.

In exemplary embodiments, the second mode of operation is selected only whilst the input member 110 is engaged. The input member 110 may be a button that is engaged when pressed and unengaged otherwise. Such an arrangement provides a 'hold-to-run' feature, enabling rapid switching between the first and second modes of operation. In alternative embodiments, the mode of operation may change between the first mode and the second mode, i.e. from first to second and vice versa, each time the input member 110 is engaged. For example, in such embodiments, the input member 110 may be a button or switch.

Upon activation of the second mode of operation, the leading edge 32 of the bucket 30 decreases in height and moves in a direction away from the body 12 of the working machine 10. In the second mode of operation, the decrease in height of the leading edge 32 may be restricted to a pre-determined distance.

It will be appreciated that this movement away from the body 12 may be an initial movement of the bucket 30 away from the body 30 upon activation of the second mode. Further continued simultaneous control of the first and second actuators may result in the leading edge 32 of the bucket 30 moving back towards the body 12 of the machine 10. It will be appreciated that, in the second mode of operation, leading edge 32 of the bucket 30 may move along a substantially non-linear path, for example the leading edge 32 of the bucket 30 may move along a curved or arc-shaped path. In the second mode of operation, a center of rotation of the bucket 30 may be moved along a substantially linear path, for example an upwardly inclined linear path.

Upon activation of the simultaneous control of the first actuator 106 and the second actuator 108, a lower extent of the bucket 30 may define a first height H1. The control system 100 is configured such that, during the simultaneous control of the first actuator 106 and the second actuator 108, movement of the leading edge 32 away from the body 12 is permitted, and a lower extent of the bucket 30 may be prevented from descending below the first height H1. It will be appreciated that the lowermost extent of the bucket 30 will vary during a discharge operation.

In some embodiments, the control system 100 may be configured such that the simultaneous actuation of the first and second actuators 106, 108 is not activated until the bucket 30 has reached a predetermined position relative to the working arm 26. Put another way, in the second mode of operation, the control system 100 may pivot the bucket 30 in a direction towards a pouring position in response to an input from the second controller 104, and, when the bucket reaches a predetermined position relative to the working arm, the control system 100 will simultaneously control the first and second actuators 106, 108.

In some embodiments the control system 100 may be configured to activate the simultaneous actuation of the first and second actuators 106, 108 upon operator demand and irrespective of the bucket position. As such, the operator may begin to pivot the bucket 30 until a predetermined point is reached, for example, where material begins to fall, prior to activating the second mode to instigate the simultaneous actuation. In doing so, the operator may be able to start pivoting the bucket 30 at or just beyond an edge of the container 200, and rely on the forward movement of the leading edge 32 to ensure that the load is deposited safely into the center of the container. It will be understood that the forward movement of the leading edge 32 of the bucket is movement along an axis parallel to a fore-aft direction of the working machine. For the purposes of the present application, the fore-aft direction is defined as a direction substantially parallel to the general direction between front and rear ends of the body 12 (or between the front and rear wheels 16, 18).

It will be appreciated that the predetermined position of the bucket 30 relative to the working arm 26 may be dependent upon on a size and/or shape of the bucket. The predetermined position of the bucket 30 relative to the working arm 26 may also be dependent upon a type of material carried by the bucket 30. In such arrangements, the working machine 10 may comprise an operator input (not shown), and the control system 100 receives an operator input corresponding to the size and/or shape of the bucket 30, and/or to the material to be carried.

In the second mode of operation, the control system 100 may be configured to actuate the second actuator 108 in response to an input received from the second controller 104, and to actuate the first actuator 106 based on a predetermined ratio R relative to the actuation of the second actuator 108. Put another way, to achieve the simultaneous control of the first actuator 106 and the second actuator 108 in the second mode of operation, the control system 100 is configured such that the second controller 104 controls pivoting of the bucket 30 relative to the working arm 20, and the control system 100 controls extension of the working arm 20 based on the predetermined ratio R.

The ratio R may be based on an initial position of the bucket 30 relative to the working arm 26 upon activation of the second mode of operation. Additionally or alternatively, the ratio may be based on an initial position of the bucket 30 relative to the body 12 upon activation of the second mode of operation. The initial position of the bucket 30 may be determined based on one or more of: an angle of the bucket 30 relative to the working arm 26; an angle of the working arm 26 relative to the body 12; an extension of the working arm 26; and an angle of the bucket 30 relative to the body 12. In some arrangements, the ratio may be based on a size and/or shape of the bucket 30. The ratio may also be dependent upon a type of material carried by the bucket 30. In such arrangements, the working machine 10 may comprise an operator input (not shown), and the control system 100 receives an operator input corresponding to the size and/or shape of the bucket 30 and/or to the material intended to be carried.

The control system 100 may be configured such that the speed of pivoting of the bucket 30 is restricted. In particular, the control system 100 may be configured such that the speed of pivoting of the bucket 30 is restricted in the second mode of operation.

It will be appreciated that the restricted speed of pivoting of the bucket 30 may be based on an initial position of the bucket 30 upon activation of the second mode of operation. In such arrangements, the initial position of the bucket 30 may be determined based on one or more of: an angle of the bucket 30 relative to the working arm 26; an angle of the working arm 26 relative to the body 12; an extension of the working arm 26; and an angle of the bucket 30 relative to the body 12. In some arrangements, the restricted speed of pivoting of the bucket 30 may be based on a size and/or shape of the bucket 30. In such arrangements, the working machine 10 may comprise an operator input (not shown), and the control system 100 receives an operator input corresponding to the size and/or shape of the bucket 30.

Operation of the working machine 10 will now be described with reference to FIGS. 3A-3C.

Figure 3A:
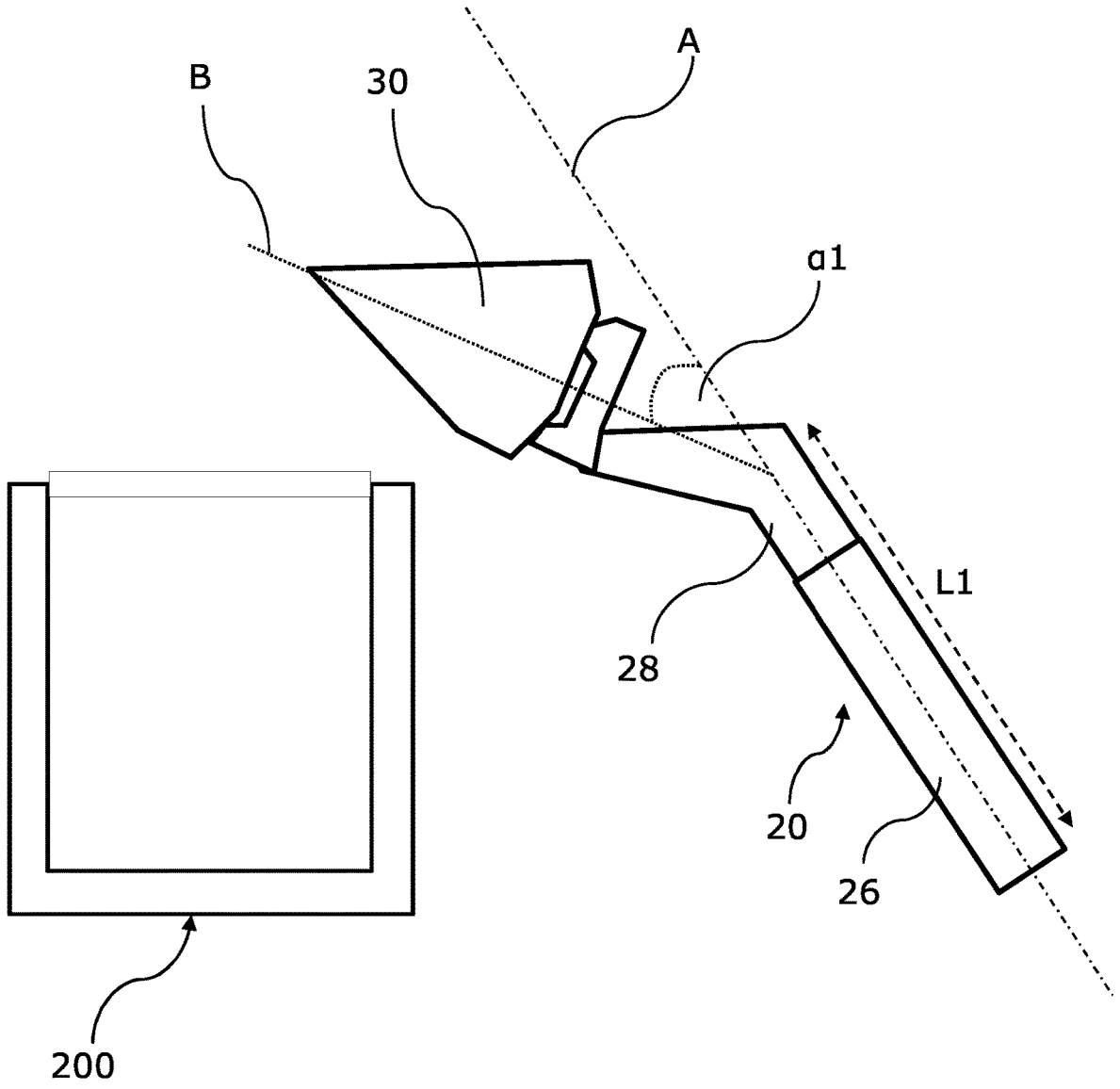
FIGS. 3A-3C are schematic representations of the working machine of FIG. 1 during different stages of a discharging operation.

FIG. 3A shows a position of the bucket 30 defined immediately upon selection of the second mode of operation via the input member 110.

As discussed above, in the second mode of operation, the control system 100 may be prevented from actuating the first actuator 106 until the bucket 30 is in a predetermined position relative to the working arm 26 and/or body 12. In the illustrated embodiment, the position of the bucket 30 relative to the working arm 20 corresponds to an angle between the bucket 30 and the working arm 20. As such, the control system 100 may be prevented from activating the second mode of operation until the angle between the bucket 30 and the working arm 20 has reached a predetermined angle. The second sensor is configured to determine the angle between the bucket 30 and the working arm 20. In FIGS. 3A-3C, the angle of the bucket 30 relative to the working arm 20 is defined as being the angle between an axis B of the bucket 30 and the elongate axis A.

The control system 100 may determine the predetermined position of the bucket 30 relative to the working arm 20 based on the initial position of the bucket 30 determined upon activation of the second mode of operation. Such an initial position of the bucket 30 is shown in FIG. 3A. For example, the initial position of the bucket 30 may be determined based on one or more of: the angle of the bucket 30 relative to the working arm 20; the angle of the working arm 20 relative to the body 12; the extension of the working arm 20; and the angle of the bucket 30 relative to the body 12. It will be appreciated that the angle of the bucket 30 relative to the body 12 may be determined from the angle of the bucket 30 relative to the working arm 20 and the angle of the working arm 20 relative to the body 12. The initial position of the bucket 30 may be determined via one or more sensors.

In FIG. 3A, the bucket 30 is oriented at a first angle $\alpha 1$ to the working arm 20, which is less than the predetermined angle. As such, the control system 100 may be prevented from actuating the first actuator 106, and the second controller 104 controls the second actuator 108 only.

Figure 3B:
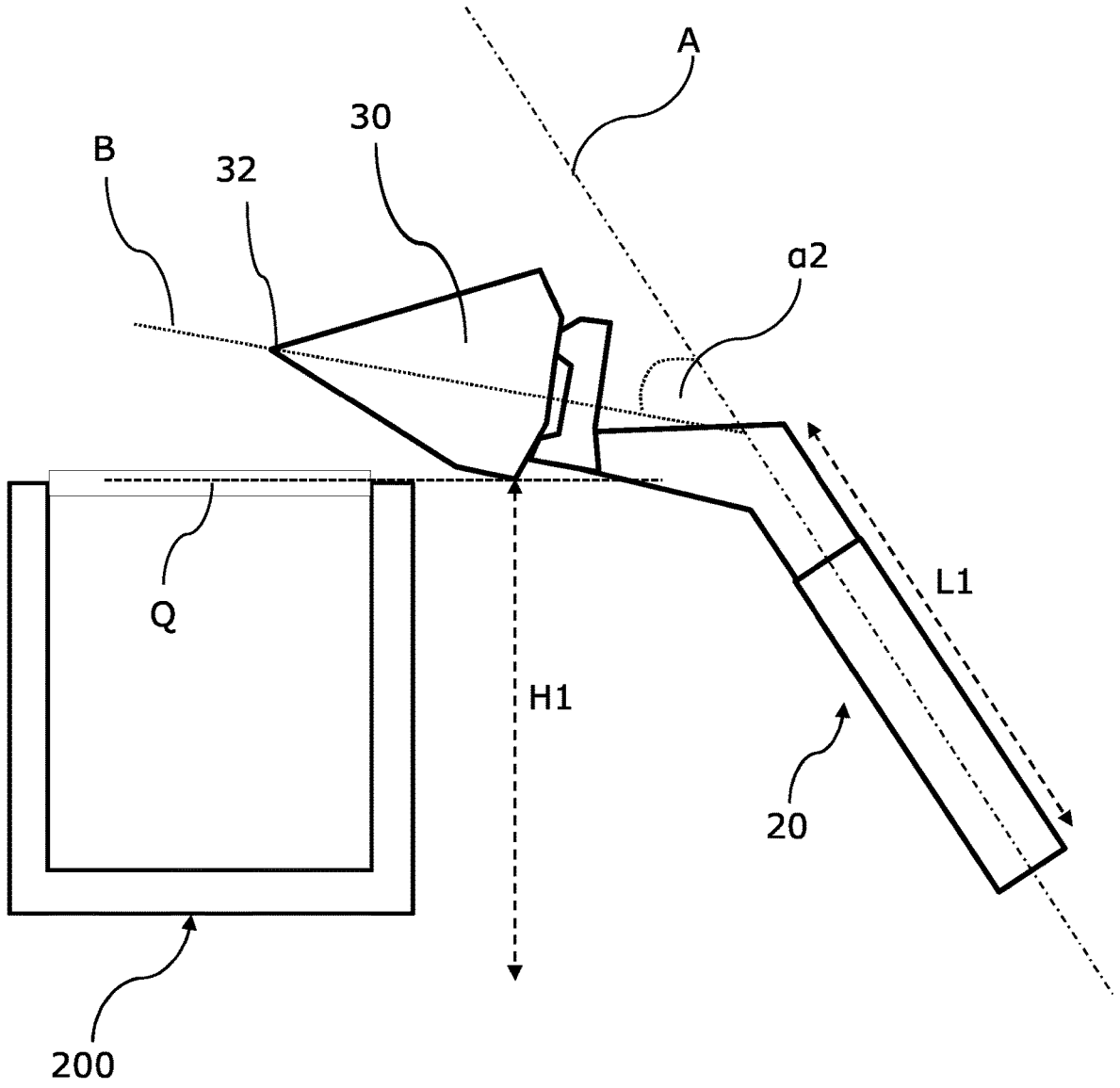

In FIG. 3B, the bucket 30 has been pivoted from the first position shown in FIG. 3A to a second position via the second controller 104, such that the angle of the bucket 30 relative to the working arm 20 is increased to a second angle $\alpha 2$, which is greater than the first angle $\alpha 1$. The movement of the bucket 30 from the first position in FIG. 3A to the second position in FIG. 3B corresponds to movement of the bucket 30 towards a discharge position; i.e. a position of the bucket 30 in which a load carried by the bucket 30 can be discharged therefrom.

Once the bucket has reached the predetermined position (for example as illustrated in FIG. 3B) relative to the working arm 26, whilst in the second mode of operation, the control system 100 is configured to activate the simultaneous control of the first actuator 106 and the second actuator 108.

Upon activation of the simultaneous control of the first actuator 106 and the second actuator 108, a lower extent of the bucket 30 is located a first height H1 (e.g. above the ground).

Once the simultaneous control of the first actuator 106 and the second actuator 108 has been activated, the second controller 104 simultaneously controls the first actuator 106 to extend the working arm 20 and the second actuator 108 to pivot the bucket 30 in a direction towards a discharge position. Moreover, the control system 100 is configured such that movement of the leading edge 32 away from the body 12 is permitted, and a lower extent of the bucket 30 may be prevented from descending below the first height H1, thereby ensuring that the container is not struck during the tipping operation.

Figure 3C:
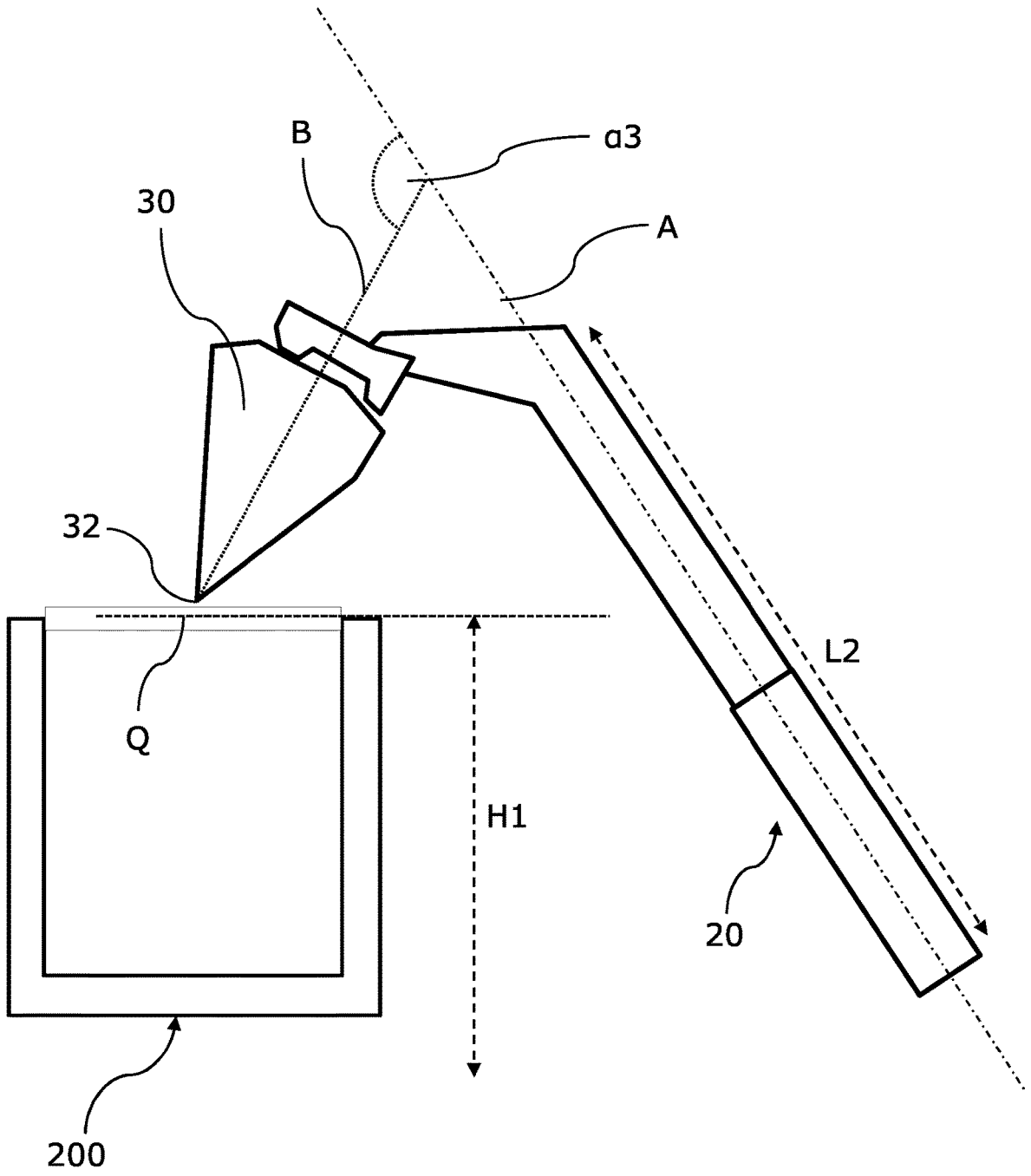

In FIG. 3C, the bucket 30 has been moved via simultaneous actuation of the first and second actuators 106, 108 from the second position shown in FIG. 3B to a third position via the second controller 104. The third position is a discharge position, i.e. a position of the bucket in which load carried by the bucket 30 can be discharged into the container 200. It will be appreciated that as the bucket 30 moves from the second position to the third position, the lower extent of the bucket 30 will vary. In FIG. 3C, the lower extent of the bucket 30 corresponds to the leading edge 32. Throughout the movement of the bucket 30 from the position shown in FIG. 3B to the position shown in FIG. 3C, the leading edge 32 has moved away from the body 12, and the lower extent of the bucket 30 has not descended below the first height H1.

As noted above, by simultaneously pivoting the bucket 30 in a direction towards the discharge position and extending the working arm 20 via the second controller 104 it makes it possible to begin tipping bucket 30 earlier in the approach whilst ensuring that the dumped content fully enters the container. Hence, upon approach, an operator may position the bucket 30 at a desired height using the angular position of the working arm 20, for example, at least level with or above the top of the container 200. As soon as the leading edge 32 of the bucket 30 reaches the edge of the container 200 the operator may be able to activate the second mode and begin to simultaneously pivot the bucket 30 and extend the working arm 20 safe in the knowledge that the leading edge of the bucket 30 will continue to extend over the container 200 ensuring that the load will be safely deposited. This allows the tipping action to be started earlier and means the forward motion of the vehicle can be stopped earlier meaning the distance travelled by the vehicle can be marginally less. Although insignificant for individual loads, the accumulative benefit over multiple cycles may be beneficial.

Another advantage of extending the leading edge 32 forward once the second mode has been activated is that it allows the leading edge 32 to take an arcuate path, allowing it to curve over the edge of the container 200. Again, this allows an operator to begin pivoting the bucket 30 prior to or when reaching the side of container 200 whilst being assured that the bucket 30 will arc over the edge of the container 200 and help avoid a collision, should the bucket 30 be slightly low on approach.

In some embodiments, the control system may be configured to be operate the first 106 and second 108 actuators solely in response to the operator activating the second mode and actuating the first 106 and second 108 actuators in a fixed ratio R as described above. The ratio R may be pre-determined to ensure that, once tipping has begun, the bucket 30 and leading edge 32 generally arc forwards to clear the side of the container 200 and dump the load within the container 200.

Providing a control system which activates a fixed ratio R actuation of the first and second actuators 106, 108 upon operator command can be realized with a simple "open loop" control scheme which avoids the need for measuring the angles of the working arm and associated sensors.

By simultaneously pivoting the bucket 30 in a direction towards the discharge position and extending the working arm 20 via the second controller 104 such that an instantaneous lower extent of the bucket 30 is prevented from descending below the first height H1, the bucket 30 can be easily controlled via a single controller to discharge a load into the container 200 without the bucket 30 striking the container 200. For example, if the working machine 10 is configured such that the first height H1 is greater than or equal to the height of the container 200, as shown in FIGS. 3B and 3C, the bucket 30 is prevented from contacting the container 200 in the second mode of operation.

To arrive at the third position shown in FIG. 3C from the second position shown in FIG. 3B, the second controller 104 has simultaneously controlled the second actuator 108 to pivot the bucket 30 to a third angle $\alpha 3$ relative to the working arm 20, which is greater than the second angle $\alpha 2$, and controlled the first actuator 106 to extend the working arm 20 to a second length L2, which is greater than the first length L1 of the working arm 20 in FIGS. 3A and 3B. The ratio R between actuation of the first and second actuators 106, 108 ensures that a lower extent of the bucket 30 is prevented from descending below the first height H1 during the simultaneous control of the first actuator 106 and the second actuator 108 in the second mode of operation.

The control system 100 is configured such that, in the second mode of operation, the leading edge 32 of the bucket 30 decreases in height relative to the initial position of the leading edge 32 defined upon activation of the second mode of operation. As shown in FIG. 3C, the leading edge 32 of the bucket 30 has decreased in height relative to the initial position of the leading edge 32 defined upon activation of the second mode of operation in FIG. 3A. Such movement of the leading edge 32 may enable the bucket 30 to move closer to the container 200 during a discharging operation, which may help the operator more accurately place a load into the container 200.

In the second mode of operation, the control system 100 is configured such that a center of rotation of the bucket 30 moves relative to the body 12. In the illustrated embodiment, in the second mode of operation, the control system 100 is configured such that the center of rotation of the bucket 30 is moved along a substantially arc-shaped path. Moving the bucket 30 along a substantially arc-shaped path helps to inhibit the bucket 30 from contacting the container 200 when, for example, the first height H1 is less than the height of the container 200.

In the second mode of operation, the control system 100 may be configured such that the first controller is prevented from controlling the first actuator 106. Put another way, the control system 100 may ignore any input received from the first controller 102. Alternatively, in the second mode of operation, the control system 100 may be configured such that the first controller 102 controls the first actuator 106. For example, in the second mode of operation, an input provided by the first controller 102 to the control system 100 may override or merge with the control of the first actuator 106 by the control system 100.

In the second mode of operation, the control system 100 may be configured to restrict the pivoting speed of the bucket 30. By 'pivoting speed', it is intended to mean the rate of change of the angle of the bucket 30 relative to the working arm 20. In the first mode of operation, the pivoting speed of the bucket 30 may be solely controlled by the second controller 104.

For example, in the second mode of operation, the control system 100 may be configured to restrict the pivoting speed of the bucket 30 such that a maximum pivoting speed of the bucket 30 in the second mode of operation is less than a maximum pivoting speed in the first mode of operation. Advantageously, such a configuration of the control system 100 may prevent the bucket 30 from inadvertently moving towards the discharge position too rapidly due to an erroneous control input to the second controller 104. Moreover, the maximum pivoting speed of the bucket 30 in the second mode of operation may be chosen to be less than or equal to the maximum or design extension speed of the first actuator 106. As such, the first actuator 106 is not prevented from implementing the requested change in extension $\Delta L$.

In exemplary embodiments, in the second mode of operation, the control system 100 may be configured to restrict the pivoting speed of the bucket 30 based on the initial position of the bucket 30 upon activation of the second mode of operation. Such an initial position of the bucket 30 is shown in FIG. 3A. For example, the initial position of the bucket 30 may be determined based on one or more of: the angle of the bucket 30 relative to the working arm 20, the angle of the working arm 20 relative to the body 12, the extension of the working arm 20, and the angle of the bucket 30 relative to the body 12. The initial position of the bucket 30 may be determined via one or more sensors. Additionally or alternatively, the control system 100 may be configured to restrict the pivoting speed of the bucket 30 based on the size and/or shape of the bucket 30.

In alternative embodiments (not shown), in the second mode of operation, the control system 100 may be configured to control the first actuator 106 based on an angle of the bucket 30 relative to the working arm 20, for example, determined by the second sensor. In such embodiments, the control system 100 may be configured to control the first actuator 106 according to a predetermined ratio between a change in extension of the working arm 102 and the determined angle of the bucket 30 relative to the working arm 20. Said ratio may be determined in a similar manner as the ratio R previously described.

In alternative embodiments (not shown), in the second mode of operation, the control system 100 may be configured to control the first actuator 106 based on a rate of change of angle of the bucket 30 relative to the working arm 20, for example, determined via the second sensor. In such embodiments, the control system 100 may be configured to control the first actuator 106 according to a determined ratio between a change in extension of the working arm 102 and the determined rate of change of angle of the bucket 30 relative to the working arm 20. Said ratio may be determined in a similar manner as the ratio R previously described.

In alternative embodiments (not shown), in the second mode of operation, the control system 100 may be configured to control the first actuator 106 according to any suitable function of the actuation of the second actuator 108. For example, the control system 100 may be configured to actuate the first actuator 106 according to a nonlinear function of a state of actuation of the second actuator 108, which ensures that during the simultaneous control of the first actuator 106 and the second actuator 108, movement of the leading edge 32 of the bucket 30 away from the body 12 is permitted and a lower extent of the bucket 30 is prevented from descending below the first height H1.

Although the teachings have been described above with reference to one or more preferred embodiments, it will be appreciated that various changes or modifications may be made without departing from the scope as defined in the appended claims.

The invention claimed is:

1. A working machine comprising:

a body;

a working arm connected to the body and configured to be telescopically extendable by a first actuator between a retracted position and an extended position;

a bucket defining a leading edge and mounted to a distal end of the working arm so as to be pivotable about an axis orthogonal to an elongate axis of the working arm by a second actuator;

a control system configured to activate first and second modes of operation;

a first controller configured to control the first actuator in the first mode of operation; and a second controller configured to control the second actuator in the first mode of operation;

wherein the control system is configured such that, in the second mode of operation, the second controller simultaneously controls the first actuator to extend the working arm and the second actuator to pivot the bucket in a direction towards a discharge position, wherein, upon activation of the second mode of operation and actuation of the first and second actuators, the leading edge of the bucket moves from a first position to a second position in a direction away from the body of the machine along a curved or arc-shaped path in which the leading edge moves in a forward direction relative to the body, and wherein the first actuator is extended when the leading edge is in both the first position and the second position.

2. The working machine of claim 1, wherein, in the second mode of operation, the leading edge of the bucket decreases in height, and wherein said decrease in height is restricted to a pre-determined distance.

3. The working machine of claim 1, wherein, upon activation of the simultaneous control of the first and second actuators, a lower extent of the bucket defines a first height and the first and second actuators are configured to move a lower extent of the bucket above the first height thereby preventing descent of the lower extent below the first height.

4. The working machine of claim 1, wherein, in the second mode of operation, the control system is configured to actuate the second actuator in response to an input received from the second controller and to actuate the first actuator based on a predetermined ratio relative to the actuation of the second actuator.

5. The working machine of claim 4, wherein the ratio is based on one or more of: an initial position of the bucket relative to the working arm; an initial position of the bucket relative to the body upon activation of the second mode of operation; a size of the bucket; a shape of the bucket; and/or a material intended to be carried by the bucket.

6. The working machine of claim 5, wherein the initial position of the bucket is determined based on one or more of: an angle of the bucket relative to the working arm; an angle of the working arm relative to the body; an extension of the working arm; and an angle of the bucket relative to the body.

7. The working machine of claim 1, wherein the first and second modes of operation are selected via an input member.

8. The working machine of claim 7, wherein the input member is located on the second controller.

9. The working machine of claim 7, wherein the second mode of operation is selected only whilst the input member is engaged.

10. The working machine of claim 1, wherein, in the second mode of operation, the control system is configured to restrict a pivoting speed of the bucket.

11. The working machine of claim 10, wherein the control system is configured to restrict the pivoting speed of the bucket based on an initial position of the bucket upon activation of the second mode of operation.

12. The working machine of claim 11, wherein the initial position of the bucket is determined based on one or more of: an angle of the bucket relative to the working arm; an angle of the working arm relative to the body; an extension of the working arm; and an angle of the bucket relative to the body.

13. The working machine of claim 10, wherein the control system is configured to restrict the pivoting speed of the bucket based on one or more of: a size of the bucket; a shape of the bucket; and/or a material intended to be carried by the bucket.

14. The working machine of claim 1, wherein, in the second mode of operation, the control system is prevented from actuating the first actuator until the bucket has reached a predetermined position relative to the working arm.

15. The working machine of claim 1, wherein the working arm is inclinable relative to the body by a third actuator, and wherein, in the second mode of operation, the control system is configured to prevent actuation of the third actuator.

16. The working machine of claim 1, wherein the bucket is pivotable towards the discharge position upon activation of the second mode of operation and actuation of the first and second actuators.

17. The working machine of claim 1, wherein, in the second mode of operation, the leading edge of the bucket decreases in height as the leading edge moves along the curved or arc shaped path.

18. A working machine comprising:

a body;

a working arm connected to the body and configured to be telescopically extendable by a first actuator between a retracted position and an extended position;

a bucket defining a leading edge and mounted to a distal end of the working arm so as to be pivotable about an axis orthogonal to an elongate axis of the working arm by a second actuator;

a control system configured to activate first and second modes of operation;

a first controller configured to control the first actuator in the first mode of operation; and a second controller configured to control the second actuator in the first mode of operation;

wherein the control system is configured such that, in the second mode of operation, the second controller simultaneously controls the first actuator to extend the working arm and the second actuator to pivot the bucket in a direction towards a discharge position, wherein, upon activation of the second mode of operation and actuation of the first and second actuators, the leading edge of the bucket moves from a first position to a second position in a direction away from the body of the machine along a curved or arc-shaped path in which the leading edge moves in a forward direction relative to the body, wherein the leading edge of the bucket moves in the forward direction relative to the body for the entirety of the curved or arc-shaped path from the first position to the second position, and wherein the first actuator is extended when the leading edge is in at least one of the first position and the second position.

19. A working machine comprising:

a body;

a working arm connected to the body and configured to be telescopically extendable by a first actuator between a retracted position and an extended position;

a bucket defining a leading edge and mounted to a distal end of the working arm so as to be pivotable about an axis orthogonal to an elongate axis of the working arm by a second actuator;

a control system configured to activate first and second modes of operation;

a first controller configured to control the first actuator in the first mode of operation; and a second controller configured to control the second actuator in the first mode of operation;

wherein the control system is configured such that, in the second mode of operation, the second controller simultaneously controls the first actuator to extend the working arm and the second actuator to pivot the bucket in a direction towards a discharge position, wherein, upon activation of the second mode of operation and actuation of the first and second actuators, the leading edge of the bucket moves from a first position to a second position in a direction away from the body of the machine along a curved or arc-shaped path in which the leading edge moves in a forward direction relative to the body whilst the first actuator is extended, and wherein the leading edge of the bucket is higher than an upper surface of the body in both the first position and the second position.

20. The working machine of claim 19, wherein whilst following the curved or arc-shaped path the bucket is movable over a lip of a container positioned higher than the body of the working vehicle for avoiding collision with said lip of said container.

* * * * *